US012305944B2

(12) United States Patent
Thuvander

(10) Patent No.: US 12,305,944 B2
(45) Date of Patent: May 20, 2025

(54) BARREL AND LAUNCHING DEVICE AS WELL AS METHOD FOR FIRING OFF A PROJECTILE

(71) Applicant: BAE SYSTEMS BOFORS AB, Karlskoga (SE)

(72) Inventor: Fredrik Thuvander, Karlstad (SE)

(73) Assignee: BAE SYSTEMS BOFORS AB, Karlskoga (SE)

( * ) Notice: Subject to any disclaimer, the term of this patent is extended or adjusted under 35 U.S.C. 154(b) by 0 days.

(21) Appl. No.: 18/574,010

(22) PCT Filed: Jun. 25, 2022

(86) PCT No.: PCT/SE2022/050634
§ 371 (c)(1),
(2) Date: Dec. 23, 2023

(87) PCT Pub. No.: WO2023/277768
PCT Pub. Date: Jan. 5, 2023

(65) Prior Publication Data

US 2024/0295375 A1 Sep. 5, 2024

(30) Foreign Application Priority Data

Jul. 1, 2021 (SE) ..... 2100109-4

(51) Int. Cl.
*F41A 21/16* (2006.01)

(52) U.S. Cl.
CPC ..... *F41A 21/16* (2013.01)

(58) Field of Classification Search
CPC ..... F41A 21/16; F41A 21/18
See application file for complete search history.

(56) References Cited

U.S. PATENT DOCUMENTS

| | | | | |
|---|---|---|---|---|
| 2,036,292 | A * | 4/1936 | Moore | F42B 10/10 102/501 |
| 3,643,364 | A * | 2/1972 | Koch | F41A 21/18 42/78 |
| 3,786,589 | A * | 1/1974 | Kaltmann | F41A 21/18 42/78 |
| 2022/0187041 | A1* | 6/2022 | Caudle | F41A 21/18 |

FOREIGN PATENT DOCUMENTS

| | | | |
|---|---|---|---|
| EP | 0319877 | A2 | 6/1989 |
| EP | 0892238 | A2 | 1/1999 |
| EP | 3742103 | A1 | 11/2020 |
| GB | 1591226 | A | 6/1981 |
| RU | 2206856 | C2 | 12/2022 |

OTHER PUBLICATIONS

International Search Report (Aug. 26, 2022) for corresponding International App. PCT/SE2022/050634.
Carlsson, Torgny "Verkstadsmatteknik", Boras 1999,; pp. 183-185; figures 16,17.

* cited by examiner

*Primary Examiner* — Derrick R Morgan
(74) *Attorney, Agent, or Firm* — WRB-IP PLLC

(57) ABSTRACT

A barrel for a launching device for launching projectiles with a propellant charge is arranged with a cross-section in the form of a curve of constant width. A launching device and a method for firing a rotation-stabilized projectile from a barrel are also provided.

6 Claims, 3 Drawing Sheets

BARREL AND LAUNCHING DEVICE AS WELL AS METHOD FOR FIRING OFF A PROJECTILE

BACKGROUND AND SUMMARY

The present invention concerns a barrel for a launching device for firing off projectiles using a propellant charge. The invention further concerns a launching device and a method for firing a rotation-stabilized projectile from a barrel.

In conventional barrel-based weapon systems, the barrel cross-section of the barrel is rotationally symmetrically circular, and designed with or without rifling and adapted to be arranged in a similarly rotationally symmetrical and circular projectile. Fire tubes designed with rifling preferably designed with a pitch over the spread of the fire tube, which means that the projectile is rotated during the firing process. Rotation of the projectile is desirable to provide a rotation stabilized projectile, i.e. the projectile rotates, after the projectile has left the barrel. As an alternative to a rotation-stabilized projectile, the projectile can be stabilized by means of, for example, fins. In such cases, it may be preferable for the projectile not to rotate when it leaves the barrel. Thus, in such cases, the projectile can be outfitted with a sliding belt, which causes the projectile to either not rotate or only partially rotate during the projectile's launch phase when the projectile is fired in a rifled barrel. When the projectile leaves the barrel in this case, the projectile is stabilized by fins arranged on the projectile. As an alternative, the projectile can be fired from a barrel without rifling, also called smooth-bore, which results in no rotational force being transmitted to the projectile during the firing process.

Patent documents U.S. Pat. No. 694,833 as well as RU 2 206 856 C2 6 describe a barrel designed with an elliptical cross-section with a pitch in the barrel, which means that the projectile is rotated during the firing process without the use of rifling in the barrel. The patent document does not show a cross-section adapted for requirements regarding manufacturing technology, strength or adaptation to a projectile design.

Patent document U.S. Pat. No. 4,664,664 describes a barrel designed with a polygon-shaped cross-section with a pitch in the barrel, which means that the projectile is rotated during the firing process without the use of rifling in the barrel. The patent document does not show a cross-section adapted for requirements regarding manufacturing technology, strength or adaptation to a projectile design.

It is also known that polygonal/hexagonal rifling has been used in weapons, preferably handguns, but then as an alternative to conventional rifling and adapted for conventional circularly symmetrical projectiles as an alternative to conventional rifling. Polygonal/hexagonal rifling is thus not adapted to fire projectiles with a design adapted to the geometry of the barrel.

According to an aspect of the present invention a barrel for a launching device for launching of projectiles with a propellant charge is arranged with a cross-section in the form of a curve of constant width.

According to additional aspects of a barrel according to the invention, the following applies:

that the curve of constant width is defined by the expression $$r(\varphi) = \frac{D}{2} + \frac{C}{2}\sin(n\varphi),$$

where D is the core diameter, φ is an angle and n is an odd integer.

that n is 3.

that the barrel is designed with a pitch of between 20 and 30.

that the barrel is adapted for firing off projectiles which are designed in the shape of a curve of constant width.

that the cross-section of the projectile, the curve of constant width, is defined by the expression $$r(\varphi) = \frac{F}{2} + \frac{E}{2}\sin(n\varphi),$$

where D is the core diameter, φ is an angle and n is an odd integer.

that F<D and that E<C.

Furthermore, according to an aspect of the present invention, an improved launching device has been provided.

Furthermore, according to an aspect of the present invention, an improved method has been provided for firing rotation-stabilized projectiles from a barrel, where the projectile is fired from barrels arranged with a cross-section in the form of a curve of constant width and the cross-section is rotated with a pitch over the axial spread of the barrel.

BRIEF DESCRIPTION OF THE DRAWINGS

The invention will be described below by reference to the figures that are included there.

DETAILED DESCRIPTION

Figure 1:
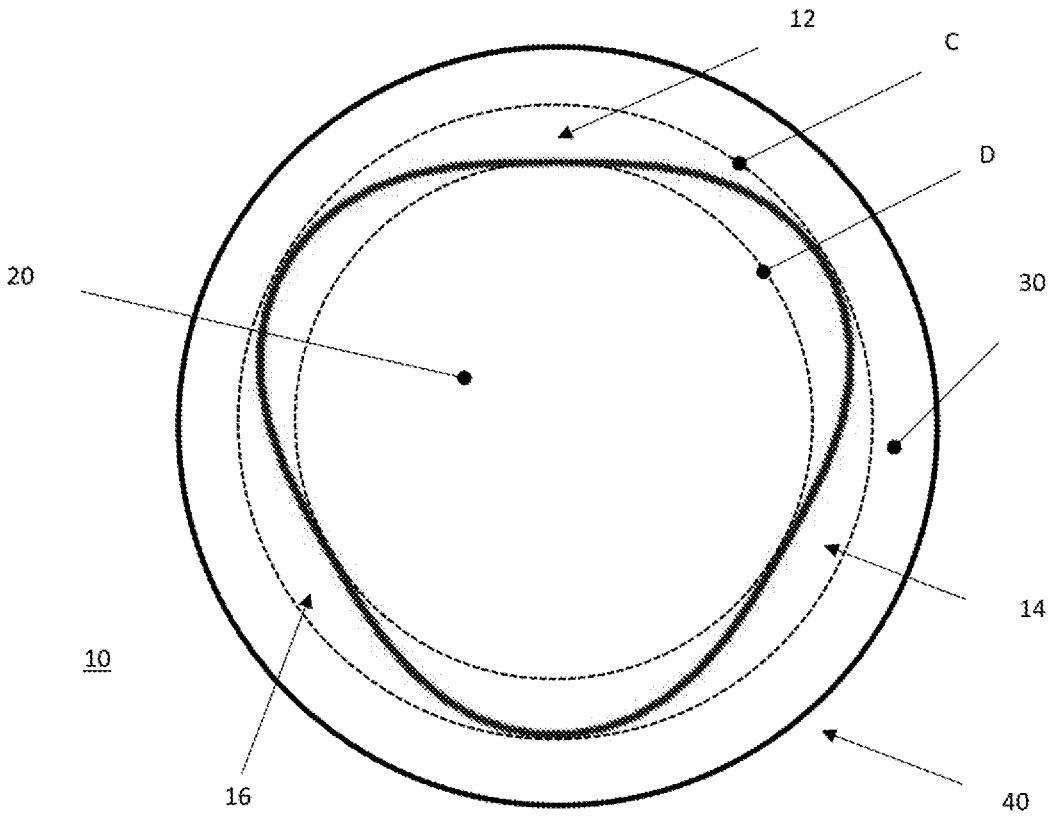
FIG. 1 shows a barrel in a view from the short side according to one embodiment of the invention.

The present invention points to a new and alternative design of a barrel intended for barrel-based launchers. An ejection device, also termed a cannon, a howitzer or a piece, in the sense of an artillery piece, has the goal of making use a propellant for the purpose of firing a projectile. Preferably, a propellant, such as gunpowder, is initiated in one part of the cannon, oftentimes a chamber specifically adapted to the purpose. Initiation takes place by way of igniting the fuze, for instance by means of an ignition cartridge or an igniter in an ammunitions device, which is initiated by means of striking. Other methods for igniting the propellant may include ignition of the propellant by means of laser energy or electric energy. The propellant burns at a high rate and results in large amounts of gas being produced, which creates a gas pressure in the chamber which propels the projectile out of the barrel of the firing ejection device. The propellant has been adapted in order to generate a constant pressure on the projectile during the entire barrel procedure, to the greatest extent possible, as the projectile moves in the barrel, which results in the projectile leaving the mouth of the barrel with high speed.

Projectiles, such as various types of grenades, generally include some form of operational part and some form of fuze which initiates the operational part. Barrels can be of different types where contact fuses are common for projectiles that are meant to burst when in contact with an object, time fuses when the projectile is meant to burst at a certain predetermined time and proximity fuses when the projectile is meant to burst when an object comes within a certain distance from the projectile. The use of zone barrels is preferred when confronting flying vessels, while timed barrels can be used when confronting a large number of various objects. It is advantageous to combine various types of barrel functions in one and the same barrel, for instance in order for the projectile to burst after a certain time if it fails to detect any object, and so on.

It is advantageous for the operational part to comprise some type of explosive substance, as well as some type of shattering casing which encloses the explosive substance. Various types of propellants, such as fins, can furthermore be arranged in either the barrel or in its own subcomponent.

In order to stabilize the projectiles after the projectiles have left the barrel, the projectiles are preferably designed with rotation or with fins. In cases where the projectiles are designed with rotation, the projectiles are said to be rotationally stabilized and in cases where the projectiles are arranged with fins, the projectiles are said to be fin-stabilized. Fin-stabilized projectiles should have no rotation, or low rotation, when leaving the barrel.

To achieve rotation on the projectiles, the barrel is often designed with rifling, to which the projectile connects during the firing process. Rifling means that the barrel in a firearm, the barrel, is provided with spiral-shaped rifling. The opposite is smooth-bore barrel. When the rifling engages the projectile during firing, it rotates along its longitudinal axis. Due to the rotation, minor irregularities or damage to the projectile will not cause a drift in the trajectory of the projectile. Rotation is also necessary for an elongated (torpedo-shaped) projectile to maintain its direction after leaving the barrel and not start tumbling around. This is referred to as the projectile being rotation-stabilized. In smooth-bore weapons, only round (spherical) projectiles or fin-stabilized projectiles can be fired. An elongated projectile without fins will tumble as it leaves the muzzle.

Thus, rifling consists of or comprises grooves that are integrated into the track of the barrel, and the elevation in between is referred to as barriers. The rifling of fine-caliber firearms usually consists of or comprises four grooves that are turned to the right, while cannons, such as artillery pieces, have more grooves depending on the caliber of the launching device. In order for the rifling to be able to engage the projectile, the projectile must either be slightly larger than the diameter between the barriers, which is common for fine-caliber weapons, or be equipped with a special flange, called a belt, which has a slightly larger diameter than the barriers, which is common in projectiles with a diameter greater than 20 mm. The belt can be made out of plastic, composite material or a soft metal, such as brass. The length of the barrel on which the groove rotates an entire revolution is called pitch and is usually the number of inches per revolution. A pitch of 1:10 inches means that the projectile rotates a revolution of 10 inches. The corresponding pitch in millimeters is written 1:254 mm. The pitch is adjusted so that the projectile obtains the initial rotational speed required for it to maintain the required stability throughout its trajectory from launch to target, i.e. without losing its stability and starting to tumble around.

Most barrels include rifling, and, by arranging projectiles with sliding belts, both rotation-stabilized and fin-stabilized projectiles can be launched with rifled barrels. Smooth-bore barrels are basically only used for weapon systems intended to armored combat vehicles, as the rotation of the projectile means that the directed explosive action, RSV, is less effective since the centrifugal force causes the beam to be spread out.

Rifled barrels suffer from problems when it comes to the connection between the belt and barrel. On the one hand, gunpowder gases can pass the projectile in cases where the coupling is not completely sealed, which results in a lower firing rate, and on the other hand, the coupling causes wear on the barrel, which shortens the life of the barrel.

By changing the barrel geometry from being a fully circularly symmetrical design, a connection to the projectile can be achieved without the use of rifling in the barrel. Preferably, geometry called a curve of constant width is used, which is a geometric shape that is not circular, and which has a diameter, the distance between two parallel lines arranged on either side of the geometric shape, which is identical regardless of location on the geometry.

Each curve of constant width is a convex set. A convex set is a set in a real or complex vector space if each point along a distance between two arbitrarily selected points in the set is also in the set. It can also be expressed as all other points being on a line of sight from each point in the set. The outer radius of a curve of constant width is crossed no more than twice for each continuous line. Barbier's theorem also states that the circumference of a curve of constant width is given in the same way as the circumference of a circle, i.e. pi times the diameter, However, the area of a curve of constant width varies based on the geometry of the curve of constant width. Each curve of constant width includes points between which there is a longer distance than the diameter of the curve of constant width.

A curve of constant width can be defined by the expression:

$$r(\varphi) = \frac{D}{2} + \frac{C}{2}\sin(n\varphi) \quad [1]$$

Where n is an odd integer that is 3 or greater, D is the core diameter, C is the rotation diameter and φ is an angle that spans the curve of constant width across the angular range of 0-2 pi.

A launching device is provided for firing, firing, projectiles with a propellant charge. The propellant charge, which can be gunpowder, for example, burns after initialization and generates a high pressure that drives the projectile out of a barrel. The projectile is arranged in the barrel by a method called hiring, it is common for a belt enclosing the projectile to be deformed relative to a groove arranged in the barrel which retains the projectile in the barrel. The propellant charge is arranged in what is often called a chamber in which the propellant charge is combusted during the generation of gases, gunpowder gases, which cause the projectile to move in the barrel. Preferably, a continuous/constant pressure is created in the chamber which also fills the barrel behind the projectile as it moves towards the mouth of the barrel.

Problems with firing projectiles arranged with a belt included the belt causing wear on the barrel as we as the seal between the projectile and the barrel loosening, thus enabling the entry of gunpowder gases, which affects the launch process, among other things by the fact that it results in the projectile launch speed, V0, varying between different projectiles depending on differences in the seal between the projectile and the barrel.

The pitch of the rotation in the barrel corresponds to the rifling of a conventional rifled barrel and is the distance to a full turn of the rotation expressed as 1 turn in 10 inches" (1:10 inches) or expressed in metric dimensions as 1 turn in 254 mm" (1:254 mm)). A shorter distance means a faster rotation, which means that for a given launch speed, the projectile will rotate at a higher rotational speed. The combination of projectile length, weight, and design determines the rotational speed required to stabilize the projectile. In general, short projectiles with a high diameter (coarse caliber) require a lower rotational speed compared to long projectiles with a small diameter (fine caliber).

Barrels can also be manufactured with progressively increasing pitch. Extremely long projectiles, such as dart ammunition, also called flechette, can be difficult to rotationally stabilize, which is why they are instead preferably fin-stabilized.

For best performance, the barrel should have a pitch that is high enough for the projectile to have such a high rotational speed that the projectile is rotationally stabilized, but the pitch should not be so large that the rotational speed is much higher than is required to achieve rotational stabilization. Coarser projectiles lead to better stabilization when a higher momentum is achieved, while elongated projectiles have an aerodynamic pressure point with leverage, which results in lower stability.

An alternative expression for the pitch is:

$$\text{Pitch} = \frac{L}{D_{cross-section}} \quad [2]$$

Where Pitch is rotation expressed in caliber, L is the length of the barrel needed to achieve a full rotational turn, Dcross-section is the caliber, or the inner diameter of the barrel.

By designing the barrel with a cross-section in the form of a curve of constant width which is rotated with a pitch of between 20-30, the barrel can be designed with smooth walls and rotation of the projectile can be achieved by pitch, the rotation of the barrel cross-section over the axial distribution of the barrel, causes rotation on a projectile traveling through the barrel. The projectiles can be shaped with a cross-section corresponding to the cross-section of the barrel but with a size slightly below the size of the barrel to be able to fit into the barrel and thus be able to be fired from the barrel. The projectiles can also be of another cross-section, for example a circular cross-section, and are fired with a sabot arranged with a cross-section in the form of a curve of constant width. The sabot can be in the form of a sabot arranged around the projectile or in other ways arranged to enable a projectile to be fired into a barrel with a cross-section in the form of a curve of constant width.

FIG. 1 shows the barrel 10 seen from the short side, the radial part of the barrel, with a barrel opening 20 formed as a curve of constant width formed by three circular segments 12, 14 and 16. In the embodiment shown, the barrel 10 has a circular outer radius 40, but can also be of a different geometric shape and be adapted on the basis of, for example, advantages related to the manufacturing techniques. In an alternative embodiment, the outer radius is also in the form of a curve of constant width, which means that the wall thickness is equal over the radial distribution of the barrel. The barrel is designed with a certain wall thickness 30 and the geometry of the barrel opening cross section 20 is machined in the barrel by conventional machining methods such as, for example, various forms of cutting machining including reaming. The cross section 20 for the geometry of the barrel opening can also be called the course of the barrel. The barrel 10 can also be manufactured by additive manufacturing methods. FIG. 1 also shows the rotation diameter of the barrel C, which is the diameter which the curve of constant width creates when it has an supposed rotation, or the circle which encloses the curve of constant width. FIG. 1 also shows a circle with diameter D, the core diameter of the barrel, which is the diameter of a circle enclosed by the curve of constant width. The rotation diameter C of the barrel and the core diameter D of the barrel are two supposed diameters used in the formula for the curve of constant width.

Figure 2:
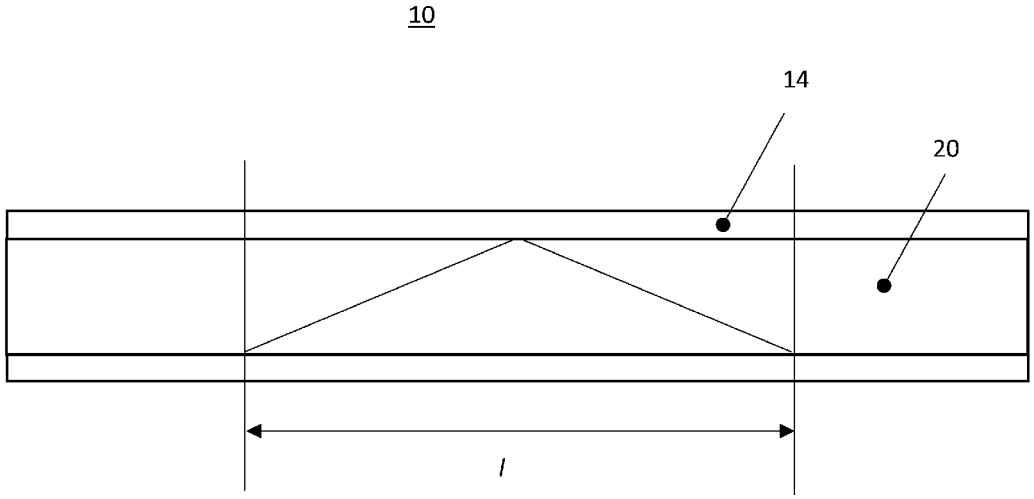
FIG. 2 shows a barrel in a view from the long side according to one embodiment of the invention.

FIG. 2 shows the barrel 10 seen from the long side, the axial direction of the barrel. The mouth of the barrel, cross-section 20, is designed in the form of a curve of constant width which rotates along the length of the barrel with a pitch that is specified by length 1 in FIG. 2. The pitch is preferably in the range 20-30.

Figure 3:
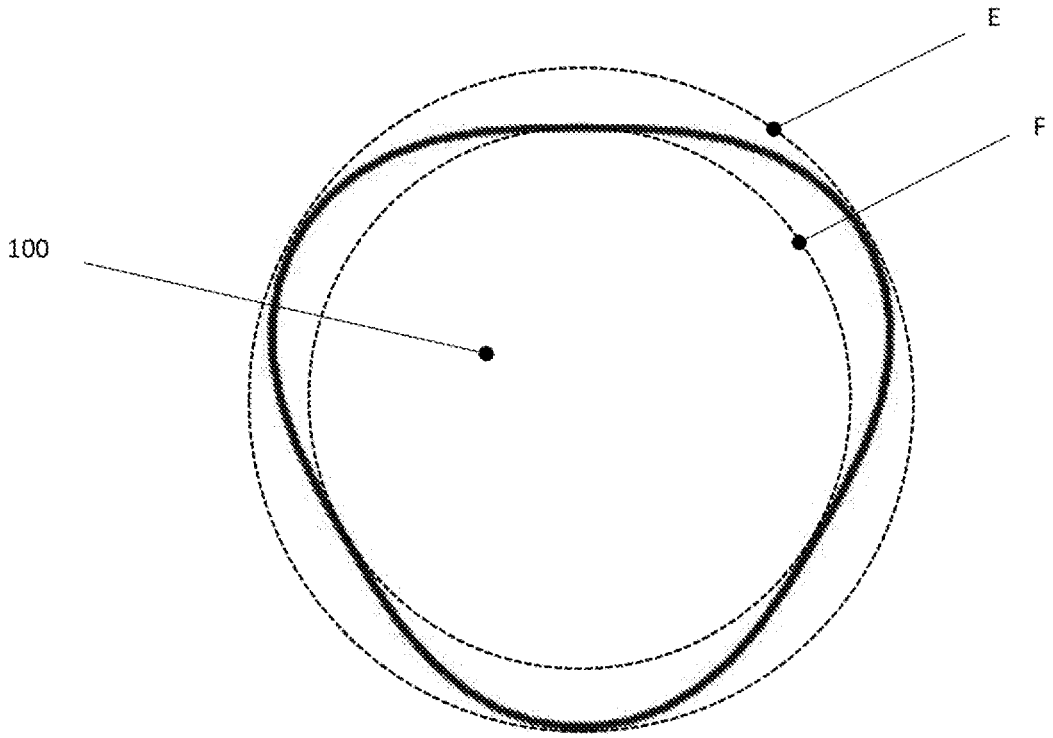
FIG. 3 shows a projectile viewed from the short side according to one embodiment of the invention.

FIG. 3 shows a projectile 100, also termed sub-caliber projectile. The projectile can be shaped with a cross-section corresponding to the cross-section of the barrel but with a size slightly below the size of the barrel to be able to fit into the barrel and thus be able to be fired from the barrel. The projectiles can also be of another cross-section, for example a circular cross-section, and are fired with a sabot arranged with a cross-section in the form of a curve of constant width. The sabot can be in the form of a sabot arranged around the projectile or in other ways arranged to enable a projectile to be fired into a barrel with a cross-section in the form of a curve of constant width. FIG. 3 also shows the rotation diameter E for the geometry of the projectile, which is the diameter which the curve of constant width creates when it has an supposed rotation, or the circle which encloses the curve of constant width. FIG. 3 also shows a circle with the diameter core diameter F for the geometry of the projectile, which is the diameter of a circle enclosed by the curve of constant width. The rotation diameter E and the projectile core diameter F are two supposed diameters used in the formula for the curve of constant width.

Examples of caliber are 20-155 mm and a length of the barrel of between 1 m and 10 m.

The invention is not limited to the embodiments specifically shown, but can be varied in different ways within the framework of the claims.

For instance, it is clear that the number, size, material and shape of the elements and details included in the barrel are to be adapted according to the projectile(s) and projectile compositions, along with other construction-related properties, which are applicable to each individual case.

In the shown embodiment, n=3 but can also be other odd integers, such as 5, 7, 9, 11, and 13.

For instance, the projectile can be arranged so that it is capable of exploding, emitting shrapnel, catching fire, exerting a thermobaric effect, fighting fires, to be used as a training projectile, in light kits, in smoke kits, to exert electromagnetic effect, bring about electromagnetic disturbances or other loads and functions.

The invention claimed is:

1. A combination of a barrel for a launching device and a projectile to be launched therefrom with a propellant charge the barrel being provided with a cross-section in a form of a curve of constant width, where the curve of constant width of the barrel is defined by an expression $$r(\varphi) = \frac{D}{2} + \frac{C}{2}\sin(n\varphi),$$

where D is a core diameter of the barrel, C is a rotation diameter of the barrel, φ is an angle and n is an odd integer greater than or equal to 3, and the projectile being made with a cross-section in a form of a curve of constant width of the projectile, where the curve of constant width of the projectile is defined by the expression $$r(\varphi) = \frac{F}{2} + \frac{E}{2}\sin(n\varphi),$$

where E is a rotation diameter E for a geometry of the projectile, and F is a core diameter for the geometry of the projectile.

2. The combination according to claim 1, wherein n is 3.

3. The combination according to claim 1, wherein the barrel is formed with a pitch of between 20 to 30 where pitch is rotation expressed in caliber where L is a length of the barrel needed to achieve a full rotational turn, and Dcross-section is a caliber so that pitch=L/Dcross-section.

4. The combination according to claim 1, wherein F<D and E<C.

5. Firing device comprising a combination according to claim 1.

6. Method for firing a rotationally stabilized projectile from a barrel, comprising providing the barrel with a cross-section in a form of a curve of constant width of the barrel by the cross-section being rotated with a pitch over an axial extent of the barrel, where the curve of constant width is defined by an expression $$r(\varphi) = \frac{D}{2} + \frac{C}{2}\sin(n\varphi),$$

where D is a core diameter of the barrel, C is a rotation diameter of the barrel, φ is an angle and n is an odd integer greater than or equal to 3, providing the projectile made with a cross-section in a form of a curve of constant width of the projectile where the curve of constant width of the projectile is defined by the expression r(φ)=F/2+E/2 sin (nφ), where E is a rotation diameter E for a geometry of the projectile, and F is a core diameter for the geometry of the, and firing the projectile from the barrel.

* * * * *